US005861578A

United States Patent [19]

Hake et al.

[11] Patent Number: 5,861,578

[45] Date of Patent: Jan. 19, 1999

[54] ELECTRICAL CONDUCTORS COATED WITH CORONA RESISTANT, MULTILAYER INSULATION SYSTEM

[75] Inventors: John E. Hake, Lafayette; David A. Metzler, Rossville, both of Ind.

[73] Assignee: REA Magnet Wire Company, Inc., Fort Wayne, Ind.

[21] Appl. No.: 788,219

[22] Filed: Jan. 27, 1997

[51] Int. Cl.[6] ..... H01B 9/02

[52] U.S. Cl. ..... 174/120 R; 174/121 SR

[58] Field of Search ..... 174/120 R, 121 SR, 174/105 SC, 107, 127

[56] References Cited

U.S. PATENT DOCUMENTS

| | | | |
|---|---|---|---|
| 1,943,115 | 1/1934 | Ellis | 148/104 |
| 2,888,424 | 5/1959 | Precopio et al. | 524/430 |
| 2,935,427 | 5/1960 | Hall et al. | 428/371 |
| 3,228,883 | 1/1966 | Di Giulio et al. | 174/110 PM |
| 3,496,139 | 2/1970 | Markovitz | 528/27 |
| 3,519,670 | 7/1970 | Markovitz | 556/402 |
| 3,555,113 | 1/1971 | Sattler | 525/429 |
| 3,577,346 | 5/1971 | McKeown | 174/110 SR |
| 3,645,899 | 2/1972 | Linson | 174/110 SR |
| 3,666,876 | 5/1972 | Forster | 174/36 |
| 3,668,175 | 6/1972 | Sattler | 528/288 |
| 3,742,084 | 6/1973 | Olyphant, Jr. et al. | 428/379 |
| 3,802,913 | 4/1974 | MacKenzie | 428/389 |
| 3,812,214 | 5/1974 | Markovitz | 528/92 |
| 3,878,319 | 4/1975 | Wahl | 174/106 SC |
| 4,049,748 | 9/1977 | Bailey | 526/192 |
| 4,102,851 | 7/1978 | Luck | 523/457 |
| 4,331,733 | 5/1982 | Evans | 524/433 |
| 4,354,965 | 10/1982 | Lee et al. | 524/104 |
| 4,403,061 | 9/1983 | Brooks et al. | 524/433 |
| 4,493,873 | 1/1985 | Keane et al. | 428/372 |
| 4,496,715 | 1/1985 | Sattler | 525/288 |
| 4,503,124 | 3/1985 | Keane et al. | 428/372 |
| 4,537,804 | 8/1985 | Keane et al. | 427/118 |

(List continued on next page.)

FOREIGN PATENT DOCUMENTS 0 396 928 11/1990 European Pat. Off. .

OTHER PUBLICATIONS

Analysis of the Impact of Pulse–Width Modulated Inverter Voltage Waveforms on A.C. Induction Motors; Austin H. Bennett; U.S. Electrical Motors, Division of Emerson Electric; No Date.

Corona Resistant Turn Insulation in AC Rotating Machine; D.R. Johnston, J.T. LaForte; Gen. Elec. Co.; No. Date.

Effect of Surge Wave Reflection Inside a Motor on Voltage Distribution Across Stator Windings; O.M. Nassar; Aramco; Apr. 1985; Saudi Arabia.

J.A. Oliver and G. C. Stone, "Implications for the Application of Adjustable Speed Drive Electronics to Motor Stator Winding Insulation", IEEE Electrical Insulation Magazine, Jul./Aug. 1995, vol. 11, No. 4, pp. 32–36.

Weijun Yin, Keith Bultemeier, Don Barta and Dan Floryan, "Critical Factors for Early Failure of Magnet Wires in Inverter–Fed Motors", IEEE 1995 Annual Report Conference on Electrical Insulation and Dielectric Phenomena, pp. 258–261.

Weijun Yin, Keith Bultemeier, Don Barta and Dan Floryan, Dielectric Integrity of Magnetic Wire Insulations Under Multi–Stresses, Proceedings of EEIC/EMCW, 1995, pp. 257–261.

*Primary Examiner*—Nestor Ramirez
*Assistant Examiner*—Joseph Waks
*Attorney, Agent, or Firm*—Baker & Daniels

[57] ABSTRACT

Electrical conductor coated with a corona-resistant, multilayer insulation system comprising first, second, and third insulation layers. The first insulation layer is disposed peripherally around the electrical conductor, the second layer is disposed peripherally around the first layer, and the third layer is disposed peripherally around the second layer. The second layer is sandwiched between the first and third layers and comprises 10 to 50 parts by weight of alumina particles dispersed in 100 parts by weight of a polymeric binder.

2 Claims, 2 Drawing Sheets

U.S. PATENT DOCUMENTS

| | | | |
|---|---|---|---|
| 4,546,041 | 10/1985 | Keane et al. | 428/372 |
| 4,716,079 | 12/1987 | Sano et al. | 428/383 |
| 4,760,296 | 7/1988 | Johnston et al. | 310/45 |
| 4,795,339 | 1/1989 | Escallon | 280/166 |
| 4,806,806 | 2/1989 | Hjortsberg | 310/45 |
| 4,816,337 | 3/1989 | Schultz | 174/120 SR |
| 4,826,706 | 5/1989 | Hilker | 427/120 |
| 4,935,302 | 6/1990 | Hjortsberg et al. | 428/383 |
| 4,966,932 | 10/1990 | McGregor et al. | 524/245 |
| 4,970,488 | 11/1990 | Horiike et al. | 338/214 |
| 4,999,247 | 3/1991 | Sugimoto et al. | 174/120 SR |
| 5,061,554 | 10/1991 | Hjortsberg et al. | 428/220 |
| 5,171,937 | 12/1992 | Aldissi | 174/36 |
| 5,336,851 | 8/1994 | Sawada et al. | 174/110 A |
| 5,552,222 | 9/1996 | Bolon et al. | 428/379 |
| 5,654,095 | 8/1997 | Yin et al. | 428/372 |

ELECTRICAL CONDUCTORS COATED WITH CORONA RESISTANT, MULTILAYER INSULATION SYSTEM

FIELD OF THE INVENTION

The present invention relates to electrical conductors coated with wire enamel compositions, and more particularly to such coated conductors in which the wire enamel compositions incorporate a corona resistant filler.

BACKGROUND OF THE INVENTION

Coated electrical conductors typically comprise one or more electrical insulation layers, also referred to as wire enamel compositions, formed around a conductive core. Magnet wire is one form of coated electrical conductor in which the conductive core is a copper wire, and the insulation layer or layers comprise dielectric materials, such as polymeric resins, coated peripherally around the copper wire. Magnet wire is used in the electromagnet windings of transformers, electric motors, and the like. Because of its use in such windings, the insulation system of magnet wire must be sufficiently flexible such that the insulation does not delaminate or crack or otherwise suffer damage during winding operations. The insulation system must also be sufficiently abrasion resistant so that the outer surface of the system can survive the friction, scraping and abrading forces that can be encountered during winding operations. The insulation system also must be sufficiently durable and resistive to degradation so that insulative properties are maintained over a long period of time.

The insulation layer or layers of coated conductors may fail as a result of the destructive effects caused by corona discharge. Corona discharge is a phenomenon particularly evident in high voltage environments, such as the electromagnet wire windings of electric motors and the like. Corona discharge occurs when conductors and dielectric materials are subjected to voltages above the corona starting voltage. Corona discharge ionizes oxygen to form ozone. The resultant ozone tends to attack the polymeric materials used to form conductor insulation layers, effectively destroying the insulation characteristics of such insulation in the region of the attack. Accordingly, electrical conductors coated with polymeric insulation layers are desirably protected against the destructive effects of corona discharge.

SUMMARY OF THE INVENTION

The present invention provides an electrical conductor coated with a multilayer insulation system which is highly resistant to corona discharge. The multilayer insulation system incorporates an alumina filled layer having a relatively high alumina content. The alumina in this layer effectively forms a barrier which substantially prevents corona from attacking layers of insulation located inwardly from such barrier. The alumina filled layer by itself, however, is relatively inflexible due to its high alumina content. By itself, such an alumina filled layer would tend to crack and/or delaminate during winding operations in the event a conductor bearing such a layer were to be wound into the electromagnet windings of an electric motor or the like. Accordingly, in the practice of the present invention, the alumina filled layer is sandwiched between two, relatively flexible insulative layers which reinforce the alumina layer. The result is an insulation system which is capable of incorporating additional amounts of alumina for extra corona resistance while still maintaining the flexibility and durability characteristics required for surviving winding operations and for providing long service life.

The present invention also provides an improved way to monitor the quality of alumina filled insulation layers which are coated onto an electrical conductor. Generally, alumina filled layers comprising sub-micron sized alumina particles dispersed in a polymeric binder tend to be substantially transparent. This makes it difficult to visually assess the quality of coverage of such a layer during and after the coating process. Accordingly, one aspect of the present invention is based upon the concept of incorporating a coloring agent into such a layer so that the quality of coverage can be visually assessed. In preferred embodiments, the coloring agent itself is corona resistant to help further protect against corona discharge.

In one aspect, the advantages of the present invention are achieved by an electrical conductor coated with a corona resistant, multi-layer insulation system comprising at least three insulation layers. A first insulation layer is disposed peripherally around the electrical conductor. A second insulation layer is disposed peripherally around the first insulation layer, wherein the second insulation layer includes from about 10 to about 50 parts by weight of alumina particles dispersed in about 80 parts by weight of a polymer binder. The third insulation layer is disposed peripherally around the second insulation layer.

In another aspect, the present invention concerns an electrical conductor coated with a corona resistant insulation system wherein the insulation system includes from about 10 to 50 weight percent of sub-micron sized alumina particles and a coloring amount of a coloring agent, wherein the alumina particles and the coloring agent are dispersed in a polymeric binder.

In still another aspect, the present invention concerns a method of coating an electrical conductor with a multi-layer insulation system. In an initial step, the conductor is coated with a first coating (the "base" coating) comprising a polymeric resin. The coated conductor bearing the first coating is then coated with a second coating (the "shield" coating) comprising from about 10 to about 50 parts by weight of alumina particles dispersed in about 80 parts by weight of a polymeric binder. The coated conductor bearing the first and second coatings is then coated with a third coating (the "top" coating) comprising a polymeric resin.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE PREFERRED EMBODIMENTS

Figure 1:
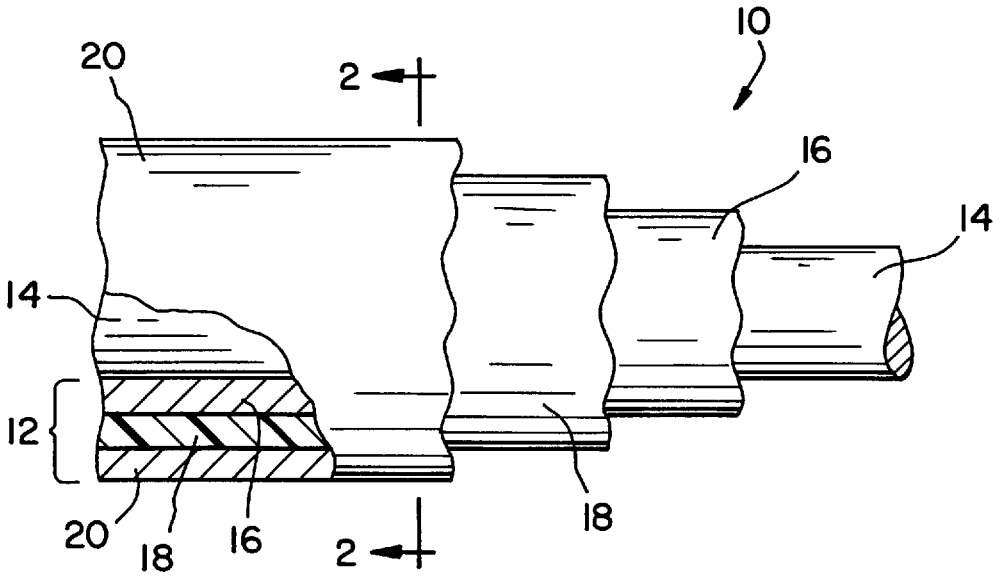
FIG. 1 is a fragmentary side elevation partly broken away and partly shown in section of a magnet wire of the present invention.
Figure 2:
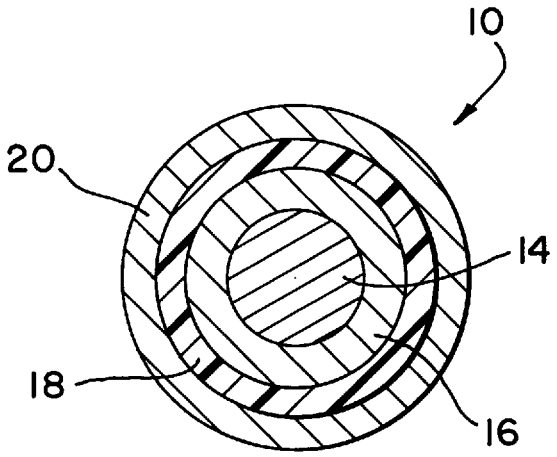
FIG. 2 is a sectional end view taken on plane 2—2 of FIG. 1.

FIGS. 1–2 show one embodiment of a coated electrical conductor configured in accordance with the various aspects of the present invention. The following description is intended to be only representative of the manner in which the principles of the present invention may be implemented in various actual embodiments. The embodiments disclosed below are not intended to be an exhaustive representation of the present invention. Nor are the embodiments disclosed below intended to limit the present invention to the precise form disclosed in the following detailed description.

Referring now to FIGS. 1–2, the coated electrical conductor shown is in the form of a magnet wire 10 which includes a multilayer insulation system, generally designated 12, coated around a conductive core 14. In the preferred embodiment shown, multilayer insulation system 12 includes a first, innermost layer 16, a second, intermediate layer 18, and a third, outermost layer 20. Although multilayer insulation system 12 is illustrated as comprising these three layers, more or less layers could be utilized depending upon which one or more aspects of the present invention are to be incorporated into magnet wire 10.

Conductive core 14 is generally a copper wire. Of course, the present invention does not require this, and conductive core 14 could be formed from any other kind of conductive material, as desired. For example, instead of being formed from copper wire, conductive core 14 could be formed from copper clad aluminum, silver plated copper, nickel plated copper, aluminum alloy 1350, combinations of these materials, or the like.

Innermost layer 16 is provided peripherally around conductive core 14 and serves as an electrically insulative, flexible base coating for multilayer insulation system 12. Because of its electrically insulative properties, first layer 16 helps insulate conductive core 14 when conductive core 14 carries electrical current during motor operations. Because of its flexibility characteristics, first layer 16 helps prevent second layer 18 from cracking and/or delaminating when magnet wire 10 is wound into the windings of an electric motor. As will be described below, second layer 18 incorporates relatively large amounts of inorganic alumina filler. As a result, second layer 18 is generally not flexible enough when used by itself to be effectively wound into the windings of an electrical motor or the like without cracking and/or delaminating. Flexible first layer 16, in cooperation with flexible third, outermost layer 20, effectively sandwich, and thus reinforce, second layer 18 to thereby substantially reduce and even eliminate the tendency of second layer 18 having a tendency to crack or delaminate during winding operations. Third, outermost layer 20 also contributes to electrical and thermally insulative properties as well as to impact resistance, scrape resistance, and windability.

Innermost layer 16 may be formed from any insulative material known in the art to be suitable for forming electrically insulative, flexible base coatings for electrical conductors. For example, such coatings may be formed from a prefabricated film which can be wound around the conductor. As another alternative, such coatings may be formed using extrusion coating techniques. More preferably, such coatings are formed from one or more fluid thermoplastic or thermosetting polymeric resins which are coated onto the conductive core 14 and then dried and/or cured, as desired, using one or more suitable curing and/or drying techniques such as chemical, radiation, or thermal treatments. A variety of such polymeric resins are known in the art and include terephthalic acid alkyds, polyesters, polyesterimides, polyesteramides, polyesteramideimides, polyesterurethanes, polyurethanes, epoxy resins, polyamides, polyimides, polyamideimides, polysulphones, silicone resins, polymers incorporating polyhydantoin, phenolic resins, vinyl copolymers, polyolefins, polycarbonates, polyethers, polyetherimides, polyetheramides, polyetheramideimides, polyisocyanates, combinations of these materials, and the like.

In one embodiment of the present invention, a combination of such resins found to be suitable for forming first layer 16 comprises from 70 to 100, more preferably about 90 parts by weight of a polyester resin incorporating tris(2-hydroxyethyl) isocyanurate ("THEIC polyester"), from 1 to 15, more preferably about 5 parts by weight of a phenolic resin, and from 1 to 15, more preferably about 4 parts by weight of polyisocyanate. A commercially available resin product incorporating such a combination of resin materials is available from the P. D. George Company under the trade designation "TERESTER 966".

Second, intermediate layer 18 comprises alumina particles dispersed in a polymeric binder. Second layer 18 incorporates an amount of alumina particles sufficient to provide magnet wire 10 with corona resistant characteristics. In the practice of the present invention, a coated conductor such as magnet wire 10 is deemed to have corona resistance if, when subjected to one or more voltage pulses greater than the corona inception voltage, the time to failure by short circuit is at least two times, preferably at least about 10 times, and more preferably at least about 100 times that of an unfilled coated conductor which is otherwise identical to the filled coated conductor.

In selecting an appropriate alumina content to be used in second layer 18, it is necessary to balance competing performance and practicality concerns. For example, if the alumina content of layer 18 is too low, layer 18 may have insufficient corona resistance. On the other hand, if the alumina content of layer 18 is too high, layer 18 may be too brittle such that layer 18 could crack or delaminate during winding operations. Using more alumina than is needed to provide the desired degree of corona resistance may also unnecessarily increase the expense of fabricating magnet wire 10 and may also make it more difficult to manufacture layer 18. Generally, in the practice of the present invention, incorporating 10 to 40, preferably 10 to 35, more preferably 10 to 20 parts by weight of alumina particles into about 80 parts by weight of the polymeric binder would be suitable.

Figure 3:
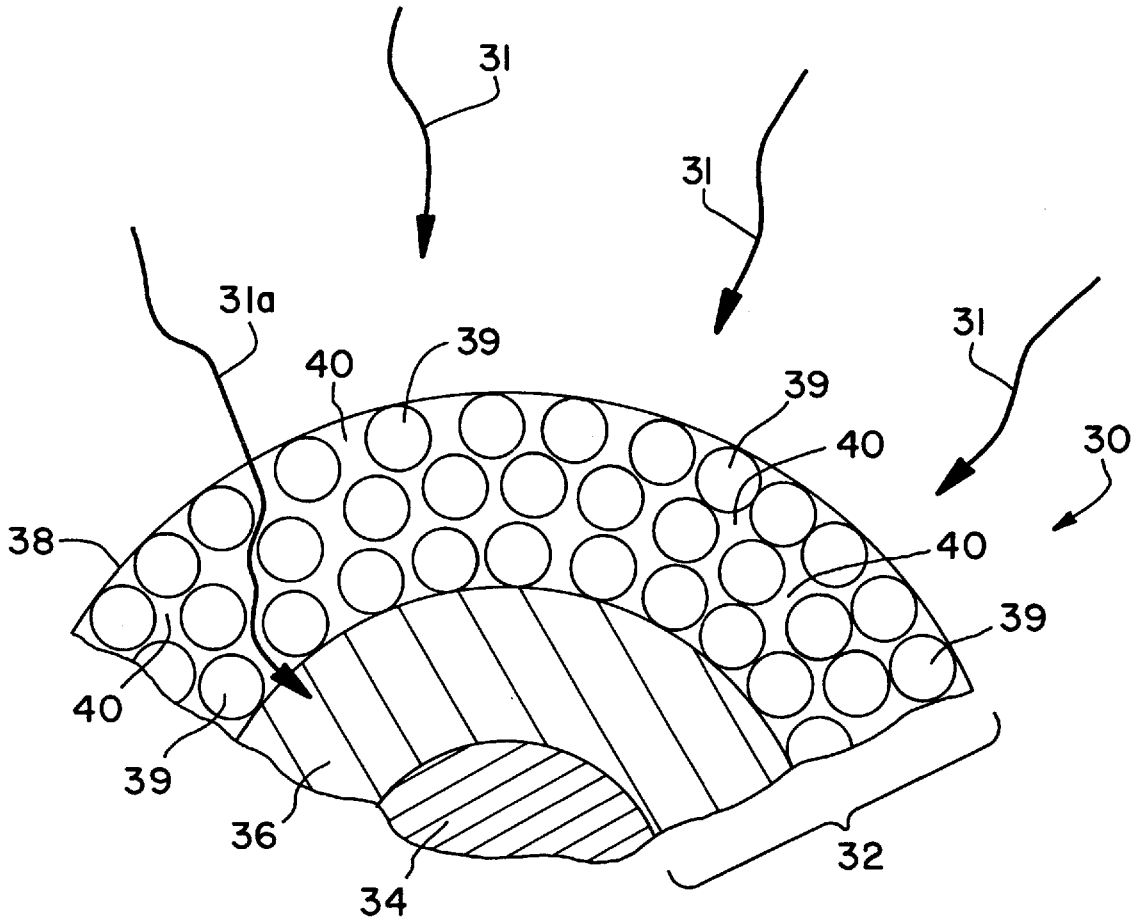
FIG. 3 is a sectional end view of a magnet wire subject to the attack of corona discharge.

Incorporation of alumina filled second layer 18 into multilayer insulation system 12 greatly enhances the corona resistance of magnet wire 10. The enhanced corona resistance is generally due to the relatively high alumina content of layer 18. While not wishing to be bound by theory, a rationale for such corona resistance can be suggested with reference to FIG. 3. Referring to FIG. 3, there is shown a schematic sectional end view of a magnet wire 30 of the present invention which is being attacked by corona discharge 31 and 31*a*. Magnet wire 30 includes a multilayer insulation system 32 surrounding a conductive core 34. Innermost layer 36 serves as an electrically insulative, flexible basecoat, and second layer 38 incorporates alumina particles 39 dispersed in a polymeric binder in order to provide corona resistive properties. Second layer 38 also provides electrically insulative properties. A third, outermost layer is not shown, because such a layer has been etched away in the area of the corona attack. The alumina particles 39 are highly resistant to corona, and thus form a protective barrier, or shield, around innermost layer 36. Because of this protective barrier, substantial portions of the corona 31 are prevented from attacking innermost layer 36. As a result, the insulative properties of innermost layer 36 and second layer 38 are preserved.

In the practice of the present invention, it is generally desirable to use alumina particles having a mean particle size as small as is practically possible, because smaller particles have a higher packing density, and thereby form a better protective barrier, than larger particles. Generally, using sub-micron sized alumina having a particle size of less than 1 micron, preferably 0.005 to 0.25 micron, would be suitable in the practice of the present invention. Alumina is known to exist in either the alpha or gamma form. Although either could be used in the practice of the present invention, we have found that gamma alumina provides better corona resistance than alpha alumina. Thus, gamma alumina is the more preferred type of alumina.

Referring again to FIGS. 1–2, it is generally desirable to incorporate alumina particles into layer 18 which are characterized by as small a size, or sizes, as is practical in order to enhance packing density. However, a coating such as layer 18 which incorporates such sub-micron-sized alumina in a polymeric binder tends to be substantially transparent. This can make it difficult during manufacture to visually determine whether layer 18 has been coated entirely around layer 16. It is generally desirable to achieve substantially complete coverage with layer 18, because any uncovered portions of underlying layer 16 would be vulnerable to corona discharge. Accordingly, in preferred embodiments of the present invention, layer 18 generally incorporates a sufficient amount of a coloring agent which allows the extent of coverage of layer 18 to be evaluated by visual inspection. Incomplete, or nonuniform coverage could thereby be observed as a variation in, or lack of, the color that would otherwise be imparted by the coloring agent.

Any coloring agent could be used which is compatible with the other ingredients of layer 18, is thermally stable, and does not adversely affect the performance characteristics of layer 18. For example, suitable coloring agents would include liquid coloring agents such as a dye, surface agents which coat or chemically alter the surface of the alumina particles to provide the surface of the alumina particles with a color which can be visually observed, a solid coloring pigment which would be combined in admixture with the other ingredients of layer 18 such as titanium dioxide, and the like. Of these materials, titanium dioxide is most preferred. Titanium dioxide is characterized by an easily observed white color and also has excellent opacity characteristics. Furthermore, titanium dioxide also has corona resistant properties so that its use also would enhance the corona resistance of magnet wire 10. When titanium dioxide is used as the coloring agent, it is preferred that the insulation layer include a weight ratio of alumina to titanium dioxide in the range from 1:19 to 19:1. More preferably, using 0.1 to 30, preferably 0.1 to 10 parts by weight of titanium dioxide based upon 10 to 40 parts by weight of alumina particles would be suitable in the practice of the present invention. Within this range, using 15 to 20 parts by weight titanium dioxide per 100 parts by weight of alumina is most preferred. Using titanium dioxide particles having a size in the range of 0.005 to 0.25 microns is also preferred.

Still referring to FIGS. 1–2, the polymeric binder of second, intermediate layer 18 may be formed from any material, or combination of materials known in the art to be suitable for forming a polymeric binder for wire enamel compositions. For example, such coatings may be formed from one or more fluid thermoplastic or thermosetting polymeric resins which are mixed with the alumina particles and other additives, if any, then coated onto layer 16, and then dried and/or cured, as desired, using one or more suitable curing and/or drying techniques such as chemical, radiation, or thermal curing treatments. A variety of such polymeric resins are known in the art and include terephthalic acid alkyds, polyesters, polyesterimides, polyesteramides, polyesteramideimides, polyesterurethanes, polyurethanes, epoxy resins, polyamides, polyimides, polyamideimides, polysulphones, silicone resins, polymers incorporating polyhydantoin, phenolic resins, vinyl copolymers, polyolefins, polycarbonates, polyethers, polyetherimides, polyetheramides, polyetheramideimides, polyisocyanates, combinations of these materials, and the like. Of these materials, polyesteramideimides are the most preferred. However, the resin materials used to form second layer 18 may be the same or different than the resin materials used to form first layer 16, as desired.

In one embodiment of the present invention, a combination of such resins found to be suitable for forming the polymeric binder of layer 18 comprises from 70 to 100, more preferably about 90 parts by weight of a polyester resin incorporating THEIC polyester, from 1 to 15, more preferably about 5 parts by weight of a phenolic resin, and from 1 to 15, more preferably about 4 parts by weight of polyisocyanate. This is the same combination of resin materials described as being suitable for forming the first layer 16, and such a combination of resin materials is available from the same commercial source under the same trade designation.

In preferred embodiments of the present invention, the polymeric binder of layer 18 may be formed from more preferred resin materials which enhance the ability of layer 18 to provide magnet wire 10 with corona resistant properties. One characteristic of the polymeric binder affecting corona resistance relates to the ability of the polymeric binder to effectively bind particles, such as the alumina, over a wide range of operating temperatures. The ability of the polymeric binder to bind particles, in turn, is affected by the increasing tendency of the particles to vibrate as the operating temperature of magnet wire 10 increases. If the binder is unable to effectively bind the particles in the event of such increased vibration, corona resistant properties may suffer, and the magnet wire 10 could even fail. We have found that polesteramideimides are particularly effective for binding alumina and other particles such as titanium dioxide particles. One specific example of a polyesteramideimide resin is commercially available from the P. D. George Company under the trade designation Tritherm A 981-85.

Third, outermost layer 20 is provided peripherally around conductive core 14 and serves as an electrically insulative, flexible, abrasion resistant, lubricious outer coating for multilayer insulation system 12. Third, outermost layer 20 may be formed from any material known in the art to be suitable for forming thermally insulative, flexible, abrasion resistant, lubricious outer coatings for electrical conductors. For example, such coatings may be formed from a prefabricated film which can be wound around the conductor. More preferably, such coatings are formed from one or more fluid thermoplastic or thermosetting polymeric resins which are coated onto the second layer 18 and then dried and/or cured, as desired, using one or more suitable curing and/or drying techniques such as chemical, radiation, or thermal curing techniques. A variety of such polymeric resins are known in the art and include terephthalic acid alkyds, polyesters, polyesterimides, polyesteramides, polyesteramideimides, polyesterurethanes, polyurethanes, epoxy resins, polyamides, polyimides, polyamideimides, polysulphones, silicone resins, polymers incorporating polyhydantoin, phenolic resins, vinyl copolymers, polyolefins, polycarbonates, polyethers, polyetherimides, polyetheramides, polyetheramideimides, polyisocyanates, combinations of these materials, and the like. Of these materials, the resin or resins to be used in the third layer 20 preferably comprise a relatively high Tg thermoplastic resin such as a polyamide-imide resin.

Insulation system 12 may be characterized by a total thickness, and layers 16, 18, and 20 may be characterized by individual thicknesses, within a wide range depending upon a variety of factors such as the size of the conductive core 14, the intended use of the resultant coated conductor, and the like. Generally, suitable total and individual thicknesses can be selected in accordance with industry standards such as those recited in the NEMA dimension tables. Most typically, first layer 16 may have an individual thickness of 40 to 80 percent, preferably about 65 percent, of the total thickness; second layer 18 may have an individual thickness of 15 to 40 percent, preferably 25 percent, of the total thickness; and third layer 20 may have an individual thickness of 1 to 30 percent, more preferably about 10 percent of the total thickness.

The insulation system 12 may be formed upon conductive core 14 using conventional coating processes well known in the art. Generally, homogeneous admixtures comprising the ingredients of each layer 16, 18, and 20 dispersed in a suitable solvent are prepared and then coated onto the conductive core 14 using multipass coating and wiping dies. The insulation build up is typically dried and cured in an oven after each pass.

The present invention will now be described with respect to the following examples. The following examples are intended to be only representative of the manner in which the principles of the present invention may be implemented in actual embodiments. The following examples are not intended to be an exhaustive representation of the present invention. Nor are the following examples intended to limit the present invention only to the precise forms which are exemplified.

EXAMPLES

Comparison Example A

An 18 gauge copper conductor wire was concentrically coated with an inner coating of a commercially available THEIC modified polyester insulation, (P. D. George Terester 966), which made up 80% of the total coating thickness, and an outer coating of a commercially available polyamideimide insulation, (P. D. George Tritherm 981) which was 20% of the total insulation thickness. The finished wire product met the typical requirements of the industry standard NEMA 1000 MW 35 and MW 73 heavy build specification. The purpose of this sample is for comparison to corona resistant insulation systems of the present invention.

The above coated wire was electrically and thermally stressed at various temperatures under stress conditions of ±/-1000 volts, 20 kHz, and a 50% duty cycle square wave with rise time of about 30 nanoseconds. At each temperature, at least two portions of the coated wire were tested. The following results show the time for the conditions to cause an electrical failure for each tested portion.

| Test Temperature | Time to fail in minutes |
|---|---|
| 90° C. | 4.3, 4.0, 4.7 |
| 120° C. | 3.2, 4.5 |
| 150° C. | 5.1, 6.2 |

Example 1

An 18 gauge copper conductor was concentrically coated as shown in FIGS. 1 and 2. Layer #16 was a commercially available THEIC modified polyester insulation, (P. D. George Terester 966), which made up 50% of the coating thickness. Layer #18 was 100 parts by weight polyamideimideester, 25 parts by weight of 0.38$\mu$ $Al_2O_3$, and 5 parts by weight of $TiO_2$ for color marking. This coating was ~25% of the total coating thickness. The outer coating, layer 20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification. The coated wire was tested as in Comparison Example A and the results were as follows:

| Test Temperature | Time to fail in minutes |
|---|---|
| 90° C. | 19, 42, 49, 35, 52 |
| 190° C. | 21, 32, 31, 21, 22 |
| 150° C. | 28, 30, 26, 28 |
| 180° C. | 16, 22, 25, 32 |

Example 2

An 18 gauge copper conductor was concentrically coated as shown in FIGS. 1 and 2. Layer #16 was a commercially available THEIC modified polyester insulation, (P. D. George Terester 966), which made up 50% of the coating thickness. Layer #18 was 100 parts by weight polyamideimideester, 25 parts by weight of a 5 to 1 blend of 0.38 $\mu$ and 0.01$\mu$ $Al_2O_3$, and 5 parts by weight of $TiO_2$ for color marking. This coating was ~25% of the total coating thickness. The outer coating, layer #20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification. The coated wire was tested in Comparison Example A and the results were as follows:

| Test Temperature | Time to fail in minutes |
|---|---|
| 90° C. | 679, 309, 311, 360, 436 |
| 120° C. | 68, 89, 121, 120, 162 |
| 150° C. | 47, 119, 68, 86 |
| 180° C. | 66, 84, 168, 174 |

Example 3

An 18 gauge copper conductor was concentrically coated as shown in FIGS. 1 and 2. Layer #16 was a commercially available THEIC modified polyester insulation, (P. D. George Terester 966), which makes up 50% of the coating thickness. Layer #18 was 100 parts by weight polyamideimideester, 25 parts by weight of a 1 to 1 blend of 0.38 $\mu$ and 0.01$\mu$ $Al_2O_3$, and 5 parts by weight of $TiO_2$ for color marking. This coating was ~25% of the total coating thickness. The outer coating, layer #20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification. The coated wire was tested as in Comparison Example A and the results were as follows:

| Test Temperature | Time to fail in minutes |
|---|---|
| 90° C. | 816, 831, 647, 1178 |
| 120° C. | 258, 429, 552, 837 |
| 150° C. | 78, 90, 64, 79 |
| 180° C. | 244, 250, 257, 89, 181 |

Example 4

An 18 gauge copper conductor was concentrically coated as shown in FIGS. 1 and 2. Layer #16 was a commercially available THEIC modified polyester insulation, (P. D. George Terester 966), which made up 50% of the coating thickness. Layer #18 was 100 parts by weight polyamideimideester, 25 parts by weight of 0.01$\mu$ $Al_2O_3$, and 5 parts by weight of $TiO_2$ for color marking. This coating was ~25% of the total coating thickness. The outer coating, layer #20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification. The coated wire was tested as in Comparison Example A and the results were as follows:

| Test Temperature | Time to fail in minutes |
|---|---|
| 90° C. | 1529, 797, 3110 |
| 120° C. | 643, 1139, 867, 379 |
| 150° C. | 117, 275, 409 |
| 180° C. | 268, 350, 1271, 1540 |

Example 5

An 18 gauge copper conductor was concentrically coated as shown in FIGS. 1 and 2. Layer #16 was a commercially available THEIC modified polyester insulation, (P. D. George Terester 966), which made up 50% of the coating thickness. Layer #18 was 100 parts by weight polyamideimideester, 17 parts by weight of 0.01$\mu$ $Al_2O_3$, and 3 parts by weight of $TiO_2$ for color marking. This coating was ~25% of the total coating thickness. The outer coating, layer #20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification. The coated wire was tested as in Comparison Example A and the results were as follows:

| Test Temperature | Time to fail in minutes |
|---|---|
| 90° C. | 6194, 5812, 6799, 7137 |
| 150° C. | 576, 988, 912, 1127 |
| 180° C. | 567, 239, 819, 819 |

Example 6

An 18 gauge copper conductor was concentrically coated as shown in FIGS. 1 and 2. Layer #16 was a commercially available THEIC modified polyester insulation, (P. D. George Terester 966), which made up 50% of the coating thickness. Layer #18 was 100 parts by weight polyamideimideester, 12.5 parts by weight of 0.01$\mu$ $Al_2O_3$, and 2.5 parts by weight of $TiO_2$ for color marking. This coating was ~25% of the total coating thickness. The outer coating, layer #20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification. The coated wire was tested as in Comparison Example A and the results were as follows:

| Test Temperature | Time to fail in minutes |
|---|---|
| 90° C. | 1432, 1283, 2136, 2093, 2362 |
| 150° C. | 149, 190, 204, 203, 161 |
| 180° C. | 88, 99, 139, 145, 181 |

Example 7

An 18 gauge copper conductor was concentrically coated as shown in FIGS. 1 and 2. Layer #16 was a commercially available THEIC modified polyester insulation, (P. D. George Terester 966), which made up 50% of the coating thickness. Layer #18 was 100 parts by weight polyamideimideester, 14.2 parts by weight of 0.01$\mu$ Al203, and 2.8 parts by weight of $TiO_2$ for color marking. This coating was ~25% of the total coating thickness. The outer coating, layer #20, was a commercially available polyamideimide insulation, (P. D. George Tritherm 981) which was 25% of the total insulation thickness. The finished wire product met the typical requirements of the industry standard NEMA 1000 MW 35 and MW 73 heavy build specification.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical conductor coated with a multilayer insulation system, said insulation system comprising:

(a) a first insulation layer disposed peripherally around the electrical conductor;

(b) a second insulation layer disposed peripherally around the first insulation layer, wherein said second insulation layer comprises from about 10 to about 50 parts by weight of alumina particles dispersed in about 80 parts by weight of a polymeric binder;

(c) a third insulation layer disposed peripherally around the second insulation layer; and (d) the first insulation layer comprising from about 70 to 100 parts by weight of a THEIC polyester about 1 to 15 parts by weight of a phenolic resin, and about 1 to 15 parts by weight of a polyisocyanate.

2. An electrical conductor coated with a multilayer insulation system, said insulation system comprising:

(a) a first insulation layer disposed peripherally around the electrical conductor;

(b) a second insulation layer disposed peripherally around the first insulation layer, wherein said second layer comprises from about 10 to about 50 parts by weight of alumina particles dispersed in about 80 parts by weight of a polymeric binder;

(c) a third insulation layer disposed peripherally around the second insulation layer; and (d) the second insulation layer comprising from about 70 to 100 parts by weight of a THEIC polyester about 1 to 15 parts by weight of a phenolic resin, and about 1 to 15 parts of weight by a polyisocyanate.

* * * * *

UNITED STATES PATENT AND TRADEMARK OFFICE

CERTIFICATE OF CORRECTION

PATENT NO. : 5,861,578

DATED : January 19, 1999

INVENTOR(S) : John E. Hake et al.

It is certified that error appears in the above-identified patent and that said Letters Patent is hereby corrected as shown below:

Claim 1, Col. 10, Line 48 delete "insulation" second occurrence.

Signed and Sealed this

Eighth Day of June, 1999

*Attest:*

Q. TODD DICKINSON

*Attesting Officer*

*Acting Commissioner of Patents and Trademarks*